US006773550B2

(12) United States Patent
Nygärd et al.

(10) Patent No.: US 6,773,550 B2
(45) Date of Patent: Aug. 10, 2004

(54) METHOD FOR COATING WEBS

(75) Inventors: Stina Nygärd, Lohja as (FI); Markku Leskelä , Lohja as (FI); Maija Pitkänen, Jyväskylä (FI)

(73) Assignee: M-Real Oyj, Espoo (FI)

( * ) Notice: Subject to any disclaimer, the term of this patent is extended or adjusted under 35 U.S.C. 154(b) by 0 days.

(21) Appl. No.: 10/122,723

(22) Filed: Apr. 16, 2002

(65) Prior Publication Data

US 2002/0170691 A1 Nov. 21, 2002

Related U.S. Application Data

(63) Continuation of application No. 09/154,159, filed on Sep. 16, 1998, now abandoned.

(30) Foreign Application Priority Data

Sep. 16, 1997 (FI) ..... 973703

(51) Int. Cl.[7] ..... D21H 11/00; B05D 3/12

(52) U.S. Cl. ..... 162/181.1; 106/461; 427/359; 427/372.2; 427/428; 427/356; 162/204

(58) Field of Search ..... 162/133, 181.1, 162/135; 106/461, 464, 466, 436, 404, 483; 427/356, 361, 428

(56) References Cited

U.S. PATENT DOCUMENTS

| | | | | |
|---|---|---|---|---|
| 4,241,142 | A | 12/1980 | Kaliski et al. | 428/511 |
| 5,118,533 | A | 6/1992 | Saji et al. | 427/366 |
| 5,120,365 | A | 6/1992 | Kogler | 106/415 |
| 5,158,806 | A | 10/1992 | Unger | 427/359 |
| 5,340,611 | A | 8/1994 | Kustermann et al. | 427/361 |
| 5,411,587 | A | 5/1995 | Willis et al. | 106/486 |
| 6,306,461 | B1 * | 10/2001 | Leino et al. | 427/356 |

FOREIGN PATENT DOCUMENTS

| | | |
|---|---|---|
| EP | 0 461 768 A1 | 12/1991 |
| EP | 0 496 269 | 7/1992 |
| EP | 0 624 686 A1 | 11/1994 |
| FI | 74215 | 10/1979 |
| FI | 63614 | 5/1980 |
| FI | 66221 | 3/1981 |
| FI | 67568 | 12/1984 |
| FI | 884196 | 3/1989 |
| FI | 96695 | 9/1989 |
| FI | 932475 | 5/1993 |
| FR | 2 468 688 | 5/1981 |
| GB | 496 775 | 12/1938 |
| GB | 1 001 778 | 8/1965 |
| GB | 1 030 195 | 5/1966 |
| GB | 2 189 714 A | 11/1987 |
| GB | 2 262 542 A | 6/1993 |
| WO | WO 95/28522 | 10/1995 |

OTHER PUBLICATIONS

James P. Casey, "Pulp and Paper: Chemsitry and Chemical Technology", Third Edition, vol. IV, pp. 2482–2483, 1983.*

"Handbook for Pulp & Paper Technologist, 2nd Edition", Gary A. Smook, Angus Wilde Publications, pp. 43–44, 1992.*

English Language abstract of FI 74215 (Document AN2), WPAT Accession NO. 79–81186B/45.

English Language abstract of FR 2 468 688 (Document A02), Derwent World Patents Index, WPI Accession No. 81–50171D/198128.

English Language abstract of FI 63614 (Document AP2), WPAT Accession No. 80–35899C/20.

English Language abstract of FI 66221 (Document AL3), WPAT Accession No. 81–25892D/15.

English Language abstract of FI 67568 (Document AM3).

English Language abstract of FI 96695 (Document AO3), WPAT Accession No. 89–265340/37.

English Language abstract of FI 932475 (Document AP3), WPAT Accession No. 92–219675/27.

European Search Report for EP 98 66 0092.2.

Barzyk, D., et al., "Acidic Group Topochemistry and Fibre-to–Fibre Specific Bond Strength," *J. Pulp Paper Sci.* 23(2):J59–J61 (Feb. 1997).

Dahlvik, P., et al., "Interactions in Coating Colors Induced by Temperature–Sensitive Cellulosic Polymer," *Intl. Paper and Coating Chem. Symp.*, Ottawa, Canada, pp. 155–162 (Jun. 1996).

Malinen, R., "Recent trends in kraft pulping in Finland," *Paper and Timber* 75(1–2):14–19 (1993).

Sundberg, K., et al., "Interactions between simple electrolytes and dissolved and colloidal substances in mechanical pulp," *Pulp Paper Res. J.* 9(2):125–128 (1994).

European Search Report for European Application No. EP 98 66 0001.3.

*Patent for Inventions.* Abridgments of Specifications, Herlad Printing Works, York, 1954, Abstract for U.K. Patent No. 623,357, p. 39.

*Patent for Inventions*, Abridgments of Specifications, Herlad Printing Works, York, 1954, Abstract for U.K. Patent No. 609,927, pp. 141–142.

Dialog File 351 (World Patents Index) English Language abstract of FI 884196, WPI Accession No. 89–087231/12.

(List continued on next page.)

*Primary Examiner*—Dionne A. Walls
(74) *Attorney, Agent, or Firm*—Kubovcik & Kubovcik

(57) ABSTRACT

The present invention relates to a method for coating of a fibrous web. According to the method a coating color with pigments is applied to the surface of the web and dried in order to form a coated web. The invention comprises using a coating color which contains pigments having a steep particle size distribution, a maximum of 35% of the pigment particles being smaller than 0.5 $\mu$m. The coating color is spread on the surface of the web with a coating speed of at least 1450 m/min, preferably over 1600 m/min. The coating pigment having a steep particle size distribution gives rise to a coating color which solidifies at much lower dry substance than conventional coating colors. In this way coating can be controlled at high speed without runnability and quality problems.

8 Claims, 3 Drawing Sheets

OTHER PUBLICATIONS

Grön, J., and Rantanen, R., "Surface sizing and film coating," Chapter 25 in Pigment Coating and Surface Sizing of Paper, Lehtinen, E., ed., Papermaking Science and Technology, Fapet Oy, Jyväskylä, Finland (2000), pp. 489–541.

"ACAV A2 Applications for: Blade Coating, Film Coating, Reverse Gravure," ACA Systems Ltd., Polvijärvi, Finland [retrieved on Jan. 31, 2001]. Retrieved from the Internet: <URL: http://www.aca.fi/html/body_application.html> 30 pages +1 page "Welcome to ACA Systems" showing site last modified Aug. 20, 2000.

Barzyk, D. et al., "Acidic Group Topochemistry and Fibre-to–Fibre Specific Bond Strength," *J. Pulp Paper Sci.* 23(2): J59–J61 (Feb. 1997).

Dahlvik, P., et al., "Interactions in Coating Colors Induced by Temperature–Sensitive Cellulosic Polymer," *Intl. Paper and Coating Chem. Symp.*, Ottawa, Canada, pp. 155–162 (Jun. 1996).

Sundberg, K., et al., "Interactions between simple electrolytes and dissolved and colloidal substances in mechanical pulp," *Pulp Paper Res. J.* 9(2):125–128 (1994).

European Search Report for European Application No. EP 98 6 0001.3.

*Patent for Inventions.* Abridgments of Specification, Herlad Printing Works, York, 1954, Abstract for U.K. Patent No. 623,357, p. 39.

*Patent for Inventions.* Abridgments of Specification, Herlad Printing Works, York, 1954, Abstract for U.K. Patent No. 609,927, pp. 141–142.

Grön, J. and Rantanen, R., "Surface sizing and film coating," Chapter 25 in Pigment Coating and Surface Sizing of Paper, Lehtinen, E., ed., Papermaking Science and Technology, Fapet Oy, Jyväskylä, Finland (2000) pp. 489–541.

"ACAV A2 Application for: Blade Coating, Film Coating, Reverse Gravure," ACA Systems Ltd., Polvijärvi, Finland [retrieved on Jan. 31, 2001]. Retrieved from the Internet:<URL: http://www.aca.fi/html/body_application-s.html>30 pages + 1 page "Welcome to ACA Systems" showing site last modified Aug. 20, 2000.

James P. Casey, "Pulp and Paper: Chemistry and Chemical Technology", Third Edition, vol. IV, pp. 2482–2483.

* cited by examiner

METHOD FOR COATING WEBS

This application is a continuation of application Ser. No. 09/154,159, filed Sep. 16, 1998, now abandoned.

The present invention relates to coating of papers and cardboards. In particular the invention concerns a method according to the preamble of claim 1 for coating fibrous webs, such as base papers of fine papers.

According to a method of the present kind, a coating colour containing pigments is applied to the surface of a web and dried in order to form a coated web.

A disadvantage of known coating colours and pigments contained therein is the uneven distribution of the coating material, i.e. poor coverage. In particular with small amounts of the coating colour, the poor coverage gives rise to bad printability and patchy brightness of the paper. As a remedy, large amounts of coating have been used. Attempts have been made to improve the coverage also by producing a so-called structurized coating colours. This means that a destabilization of the coating mixture has been aimed at by e.g., a cationic substance. The problem of structurization is for example poor runability and poor surface hardness which create problems during printing. Large coating amounts lead to poor opacity, bulk and cracking problems in particular with light paper qualities.

High-speed coating with the film press method is hampered by mist-forming in the coating nip which interferes with runability and impairs the quality of paper. The problem arises when the film splitting in the nip is not under control and a part of the film does not accompany the paper web or the coating roller but is directly flung out from the nip. Uncontrolled film splitting may be caused by insufficient immobilization of the coating colour before splitting. The problem can be solved by raising the immobilization point of the coating colour by increasing the dry matter content of standard coating colour. This solution to the mist-forming, however, leads to another problem. Since the amount of coating is dependent on the dry matter content of the coating colour, the feed thickness of the film will have to be reduced. The thickness of the film on the coating roll is regulated with a rotating rod. The thickness of the film can to some extent, but not sufficiently, be regulated by varying the thickness and the rotational speed of the rod. When the rod load is increased too much, which happens when the dry matter is too high, the pasta film will, however, break between the rod and the coating roll. This phenomenon is called drop formation. The coating colour flies in the form of big drops to the coating roll and big lumps are thus transferred to the paper.

As will appear from the above, also when coating is carried out with the film transfer method at high speeds it is difficult to obtain sufficient coverage. Further, at high speeds two difficult problems relating to film press coating will emerge, namely mist-formation and drop-formation. These problems lead to both defects in quality and to poor coverage.

BRIEF SUMMARY OF THE INVENTION

It is an object of the present invention to eliminate the problems of the prior art and to provide an entirely novel solution for coating of paper webs, cardboard webs and similar fibrous webs.

The present invention is based on the concept of increasing the immobilization point of the coating colour by using in the coating colour a pigment, the proportion of smallest particles of which (<0.2 $\mu$m and <0.5 $\mu$m) is approximately the same or slightly smaller than conventional pigments.

Preferably less than about 10% of the particles are smaller than 0.2 $\mu$m and a maximum of 35% are smaller than 0.5 $\mu$m. According to the invention, the proportion of mid-size pigment particles having a diameter of 0.5 to 2 $\mu$m is clearly larger than for conventional pigments, typically this proportion is over 20% greater. Within the scope of the present invention, this particle size distribution is called "steep". We have found that when the distribution is steep a good coverage and simultaneously even a better surface strength is obtainable.

The above mentioned numerical values of the particle sizes hold for spherical or approximately spherical particles measured by a Sedigraph apparatus.

The above-mentioned coating mixture is used in particular for film transfer coating at high speed which exceed 1450 m/min, when aiming at small coating amounts.

More specifically, the process according to the present invention is mainly characterized by what is stated in the characterizing part of claim 1.

The invention will provide considerable advantages. Thus, by means of the invention a product can be obtained, having excellent surface properties, excellent coverage and still good structural and optical properties. It is essential for the invention that the coating pigment which has a steep particle size distribution yield a coating colour, a paste, which immobilizes at a much lower dry matter content than traditional mixtures. In this way it becomes possible to control the aimed coating amounts at high speed without any runability and quality problems. In particular, it is possible to avoid the problems appearing during film press coating at high speeds; the coating colour immobilizes so rapidly that film splitting takes place controllably without mist-forming. Since the immobilization point can be raise without increasing the dry matter content, no drop formation occurs.

In the following the invention will be discussed more closely with the aid of a detailed description and a number of working examples.

BRIEF DESCRIPTION OF THE FIGURES

The attached drawings depict the normal and steep particle size distributions.

DETAILED DESCRIPTION OF THE INVENTION

Figure 1:
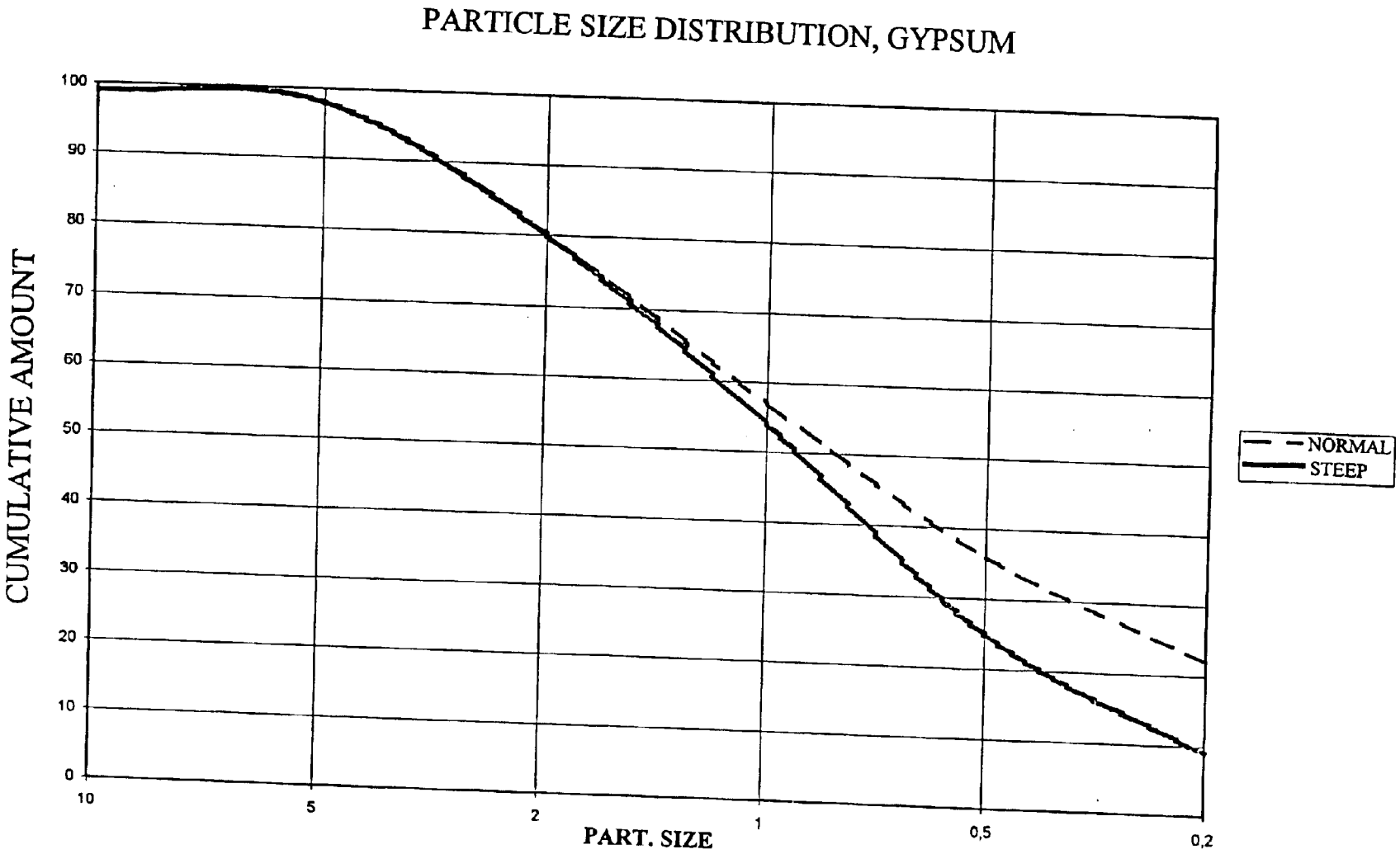
FIG. 1 depicts the normal and steep particle size distribution of gypsum.

Within the scope of the present invention, the term web stands for a material comprising paper or cardboard a corresponding cellulosic substance, which is derived from wood or annual or perennial plants. Said material can be wood-free or wood-containing and it can be prepared from mechanical, semimechanical (chemimechanical) or chemical pulp. The chemical pulp can be bleached or unbleached. The material can also comprise recycled fibers, in particular reclaimed paper or cardboard. According to a particularly preferred embodiment the web is produced from a mixture of a mechanical pulp and a chemical pulp, the proportion of the mechanical pulp being 80 to 30%. This mixture may comprise pulp produced from hardwood or softwood by mechanical defibering methods, such as GW, PGW, TMP or CTMP pulp. The raw material used can be spruce. A preferred product is obtained by coating a base paper produced from a mixture of chemical pulp and a mechanical pulp of aspen or another wood species of the Populus family. Examples of wood species of the Populus family are *P. tremula, P. tremuloides, P balsamea, P. balsamifera, P. trichocarpa* ja *P. heterophylla*. Aspen (trembling aspen, *P. tremula*; Canadian aspen *P. tremuloides*), and aspen varieties known as hybride aspens produced from different base aspens by hybridizing as well as other species produced by recombinant technology, and poplar are considered particularly advantageous. The chemical pulp can be produced by any suitable method from hardwood or softwood, in particular from softwood. The thickness of the material web is typically in the range of 30 to 250 g/m$^2$, preferably it is about 30 to 100 g/m$^2$ when coated paper is produced.

A preferred embodiment of the invention comprises coating a base paper manufactured from mechanical spruce pulp and chemical softwood pulp in order to produce LWC paper and coating a base paper manufactured from mechanical aspen pulp and chemical softwood pulp in order to produce fine papers.

The coating colours according to the invention can be used for single coating and as so called pre-coat and surface-coat colours. Preferably the material is double-coated, first with a precoating and then with a surface coating, whereby both coating colours contain pigments having a steep particle size distribution.

Generally for 10 to 100 parts by weight of at least one pigment or a mixture of pigments, the coating colour according to the invention contains about 0.1 to 30 parts by weight of at least one binder and 1 to 10 parts by weight of other known additives.

The composition of a typical pre-coat mixture is the following:

| | |
|---|---|
| pigment/filler (e.g. coarse calcium carbonate) | 100 parts by weight |
| binder | 1 to 20 parts by weight |
| additives | 0.1 to 10 parts by weight |
| water | balance |

The dry matter content of a pre-coat mix is generally 40 to 70%, preferably 50 to 65%, and the pH 7 to 9, when the coating speeds are over 1400 m/min.

The composition of a surface coating colour according to the present invention is, for example, the following:

| | |
|---|---|
| coating pigment (e.g. fine calcium carbonate) | 30 to 90 parts by weight |
| coating pigment (e.g. fine kaolin) | 10 to 50 parts by weight |
| total pigment | 100 parts by weight |
| binder | 1 to 20 parts by weight |
| additives | 0.1 to 10 parts by weight |
| water | balance |

The dry matter content of a coating colour is typically 50 to 75%.

In the above-mentioned surface coating colours at least a part (1 to 100%, preferably about 20–100%) of the finely-divided calcium carbonate can be replaced by precipitated calcium carbonate, i.e. PCC, or kaolin.

According to the invention the pigments used in the coating colours have a steep particle size distribution, a maximum of 35% of the pigment particles being smaller than 0.5 $\mu$m, and preferably a maximum of 15% are smaller than 0.2 $\mu$m.

Figure 2:
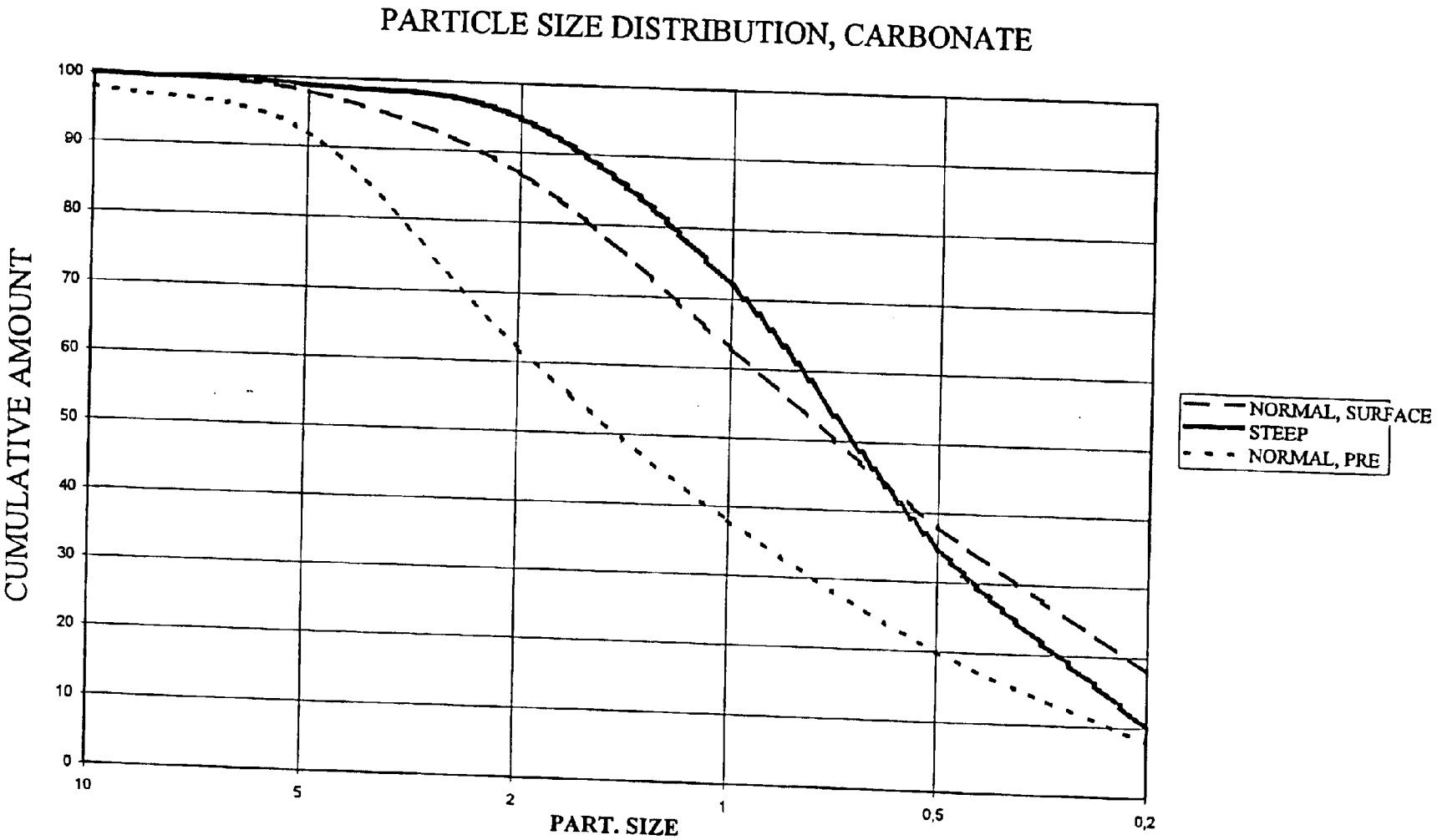
FIG. 2 depicts the normal and steep particle size distribution of carbonate.

The attached FIGS. 1 and 2 show the particle size distributions according to the present invention for gypsum and calcium carbonate, respectively, compared to conventional particle size distributions. As apparent from the figures, due to the steep distribution the cumulative particles size distribution curve of the invention lies clearly below the corresponding curve of a conventional pigment for the small pigment fractions. Correspondingly, the curve of carbonate is above that of the traditional pigments for middle size particles.

The invention can be applied to any pigment. Pigments are, e.g., calcium carbonate, calcium sulphate, aluminium silicate, kaolin (aluminium silicate containing cristallization water), aluminium hydroxide, magnesium silicate, talc (magnesium silicate containing cristallization water) titanium oxide and barium sulphate and mixtures of these. Also synthetic pigments may be used. Primary pigments of those mentioned above are kaolin and calcium carbonate, usually amounting to over 50% of the dry matter of the coating composition. Calcinated kaolin, titanium oxide, precipitated carbonate, satin white, aluminium hydroxide, sodium silica aluminate and plastic pigments are additional pigments and the amounts of these are usually below 25% of the dry matter content of the mixture. Special pigments to be mentioned are special kaolins and calcium carbonates and barium sulphate and zinc oxide.

Preferably the invention is implemented to calcium carbonate, calcium sulphate, aluminium silicate and aluminium hydroxide, magnesium hydroxide, magnesium silicate, titanium dioxide and/or barium sulphate and mixtures thereof, whereby it is particularly preferred to use as the main pigment of the pre-coat mixtures calcium carbonate or gypsum and in the surface coating colours and in single-coating colours mixtures of calcium carbonate or gypsum and kaolin.

The particle size distribution of the invention can be obtained by regulating e.g. the precipitation conditions of precipitated calcium carbonate such that the desired distribution is achieved. Alternatively, the grinding of natural minerals can be adjusted such that the desired particle sizes are obtained. The coarsest fractions can be separated from the fines by generally known screening methods.

Any binding agent know per se, which is frequently used for manufacturing paper, can be used as a binder. In addition to individual binders it is also possible to use mixtures of binding agents. As specific examples of typical binding agents the following can be mentioned: synthetic latex-type binders consisting of polymers or copolymers of ethyleneically unsaturated compounds, such as butadiene-styrene type copolymers which can contain a comonomer with a carboxylic group, such as acrylic acid, itaconic acid or maleic acid, and poly(vinyl acetate) which contains comonomers having carboxylic groups. In combination with the afore-mentioned substances e.g. water-soluble polymers, starch, CMC, hydroxy ethyl cellulose and poly(vinyl alcohol) can be used as binders.

In the coating mixture there can further be used conventional additives and adjuvants, such as dispersing agents (e.g. sodium salt of poly(acrylic acid)), substances for adjusting the viscosity and water rentention of the mixture (e.g. CMC, hydroxyethyl cellulose, polyacrylates, alginates, benzoate), lubricating agents, hardeners for improving the water resistance, optical agents, anti-foaming agents and substances for regulating the pH and for preventing product degradation. The lubricating agents include sulphonated oils, esters, amines, calcium and ammonium stearates; the agents improving water resistance include glyoxal; optical agents include diaminostilben and derivatives of disulphonic acid; the anti-foaming agents include phosphate esters, silicones, alcohols, ethers, vegetable oils, the pH-regulators include sodium hydroxide and ammonia; and, finally, the anti-degradation agents include formaldehyde, phenol and quaternary ammonium salts.

The coating colour can be applied on the material web in a manner known per se. The method according to the invention for coating paper and/or paperboard can be carried out on-line or off-line by using a conventional coater, i.e. a doctor blade coater, or by film press coating or by surface spraying. It is particularly preferred to adapt the solution to film press coating, in which it is possible to control mist-forming and drop formation at high speeds and with small coating amounts.

According to a particularly preferred embodiment, the paper web is double coated, the first coating being carried out by the film press method and the other coating by blade coating. The precoating is preferably performed by the film press method at high speed (at least 1450 m/min, preferably even 1600 m/min or more). The aimed coating amount is in precoating 8 g/m$^2$ and in surface coating 10/m$^2$ per side. Generally, the amount of coating colour applied to the web is 5–25 g/m$^2$ by the film press method and 5–40 g/m$^2$ by the blade coating, whereby the coating weights have been calculated from the dry matter of the coating.

The dry matter content of the coating colour used is at least 40%, preferably at least 50%, and in particular 50 to 65%. The immobilization point of the coating colour according to the invention is clearly lower than that of a coating colour produced from pigments having a traditional distribution. The immobilization of the coating colour already at a lower dry matter content significantly reduces mist-forming at high-speed coating with the film press method. Coating with smaller coating amounts is facilitated and drop formation can be avoided when it is not necessary to increase the dry matter of the coating colour.

By means of the invention it is possible to produce coated webs having excellent printability, good smoothness and high opacity and brightness. A particularly preferred product comprises a coated fine paper, the base paper of which has a grammage of 30 to 100 g/m$^2$ and it is produced from mechanical aspen pulp and chemical softwood pulp, the proportion of the mechanical aspen pulp of the fibrous substance of the paper is 20 to 70 weight-%. By coating a base paper of this kind, having a grammage of about 50 g/m$^2$ with a precoating of 8 g and a surface coating of 10 g/m$^2$/side a fine paper is obtained which has a grammage of 70 to 90 g/m$^2$, a brightness of at least 90%, an opacity of at least 90% and a smoothness of 1 $\mu$m or less.

The following examples illustrate the invention. The properties of the paper have been determined by the following standard methods in the examples:

Brightness: SCAN-P3:93 (D65/10°)
Opacity: SCAN-P8:93 (C/2)
Smoothness: SCAN-P76:95
Bendtsen coarseness: SCAN-P21:67
Gloss: Tappi T480 (75°) and T653 (20°)

EXAMPLE 1

Gypsum Pigment Having a Steep Particle Size Distribution

Two coating colours were prepared from gypsum. The compositions were:

| | |
|---|---|
| Gypsum | 70 parts by weight |
| Kaolin | 30 parts by weight |
| SB latex | 11 parts by weight |
| CMC | 1 part by weight |
| Optical brightners | 1 part by weight |

The dry matter contents of the coating colours were 63% and their viscosity 1500 cP (Brookfield 100 rpm).

The kaolin was a typical finely divided glazing kaolin. Two different kinds of gypsum qualities were used in the coating colours. The gypsum qualities differed from each other as regards the particle size distribution; gypsum 1 had a normal distribution and gypsum 2 a steep. The distributions are presented in Table 1:

TABLE 1

Particle size distributions of gypsum pigments

| Max. particle size | Cumulative weight ratio | |
|---|---|---|
| [$\mu$m] | Gypsum 1 (normal) | Gypsum 2 (steep) |
| 10 | 99 | 99 |
| 5 | 98 | 98 |
| 2 | 80 | 80 |
| 1 | 57 | 54 |
| 0.5 | 36 | 25 |
| 0.2 | 22 | 9 |

The particle size distributions of the gypsum pigments are also shown in the appended FIG. 1. As appear from the figure and the above table the amount of gypsum pigment particles is clearly smaller from the particle sizes of 1.8 $\mu$m downwards. Between 3 and 1.8 $\mu$m the amount of the particles is, again, somewhat larger than for traditional pigments.

When the above-described mixtures were used for coating, a better coverage was obtained with the steep distribution. Due to this the particularly important parameters for the printing result, viz. opacity, gloss and smoothness are improved by means of the invention with 5 to 20%.

EXAMPLE 2

Production of a Coated Fine Paper

A base paper was produced from a mechanical aspen pulp (GW) and chemical pine pulp, which were mixed at a weight ratio of 40 to 60. Ground calcium carbonate was added as a filler to the suspension in an amount of about 10% of the fibrous material.

The base paper was produced on a gap former. The properties of the base paper were the following:

| | |
|---|---|
| grammage | 53.3 g/m$^2$ |
| bulk | 1.45 cm$^3$/g |
| opacity | 88% |
| brightness | 82.5% |
| coarseness | 240 ml/min |
| porosity | 170 ml/min |
| filler content | 12% |

The base paper was coated twice, first with the film press method and then with doctor blade coating.

In the coating colours three kinds of calcium carbonate pigments were used. Their particle size distributions are presented in Table 2:

TABLE 2

Particle size distributions of carbonate pigments

| Max. particle size [μm] | Cumulative weight ratio | | |
|---|---|---|---|
| | Carbonate 1 (normal) | Carbonate 2 (normal) | Carbonate 3 (steep) |
| 5 | 92 | 98 | 99 |
| 2 | 62 | 87 | 95 |
| 1 | 38 | 63 | 70 |
| 0.5 | 20 | 38 | 35 |
| 0.2 | 8 | 18 | 10 |

Traditionally, product Carbonate 1 (normal, coarse) is used for precoating and product Carbonate 2 (normal, fine) for surface coating.

The coating colours were prepared by methods known per se by mixing together the pigment, binder and the additives. The compositions of the mixtures are shown in Table 3:

TABLE 3

Compositions of coating colours

| | Precoat mixture (weight parts) | | Surface coating mixture (weight parts | |
|---|---|---|---|---|
| | Conventional | According to the invention | Conventional | According to the invention |
| Carb. 1 | 100 | | | |
| Carb. 2 | | | 75 | |
| Carb. 3 | | 100 | | 75 |
| Glazing kaolin | | | 25 | 25 |
| SB latex | 10 | 10 | 11 | 11 |
| CMC | 0.5 | 0.5 | 1 | 1 |

Further, additives conventionally used in coating colours, such as optical brighteners were employed.

The dry matter content of the pre-coat mixtures were 60% and the corresponding dry matter content of surface coating colours were 61%.

The base paper mentioned at the beginning of this example was coated with the above described coating colours in the following conditions:

Precoating by the film press method: 9 g/m$^2$ per side; and the surface coating at a doctor blade station: 10.5 g/m$^2$ per side at a speed of 1500 m/min. The coated paper was super-calendered.

The properties of the end product obtained using carbonate 3 were determined and compared to those of two commercially available fine papers, viz. Lumiart (Enso) and Nopacoat (Nordland Papier). The results will appear from Table 4:

TABLE 4

Optical properties of a double-coated fine paper

| | Paper according to the invention | Lumiart | Nopacoat |
|---|---|---|---|
| Grammage [g/m$^2$] | 80 | 100 | 99 |
| Bulk | 0.85 | 0.83 | 0.78 |
| Opacity [%] | 94 | 92.7 | 92.6 |
| Brightness [%] | 94 | 91 | 96.7 |
| Smoothness pps 10 [μm] | 0.8 | 1.2 | 0.8 |
| Gloss [%] | 73 | 66 | 71 |

Table 4 shows that the properties of a fine paper produced by the invention are better in all respects than those of comparative papers having corresponding bulk and grammage which is an evidence that the method according to the invention provides better coverage. By combining the coating according to the invention to the described base paper it is possible to provide a fine paper, which gives a yield gain of over 20% compared to conventional fine papers.

EXAMPLE 3

The Influence of a Steep Distribution on Immobilization Point

Figure 3:
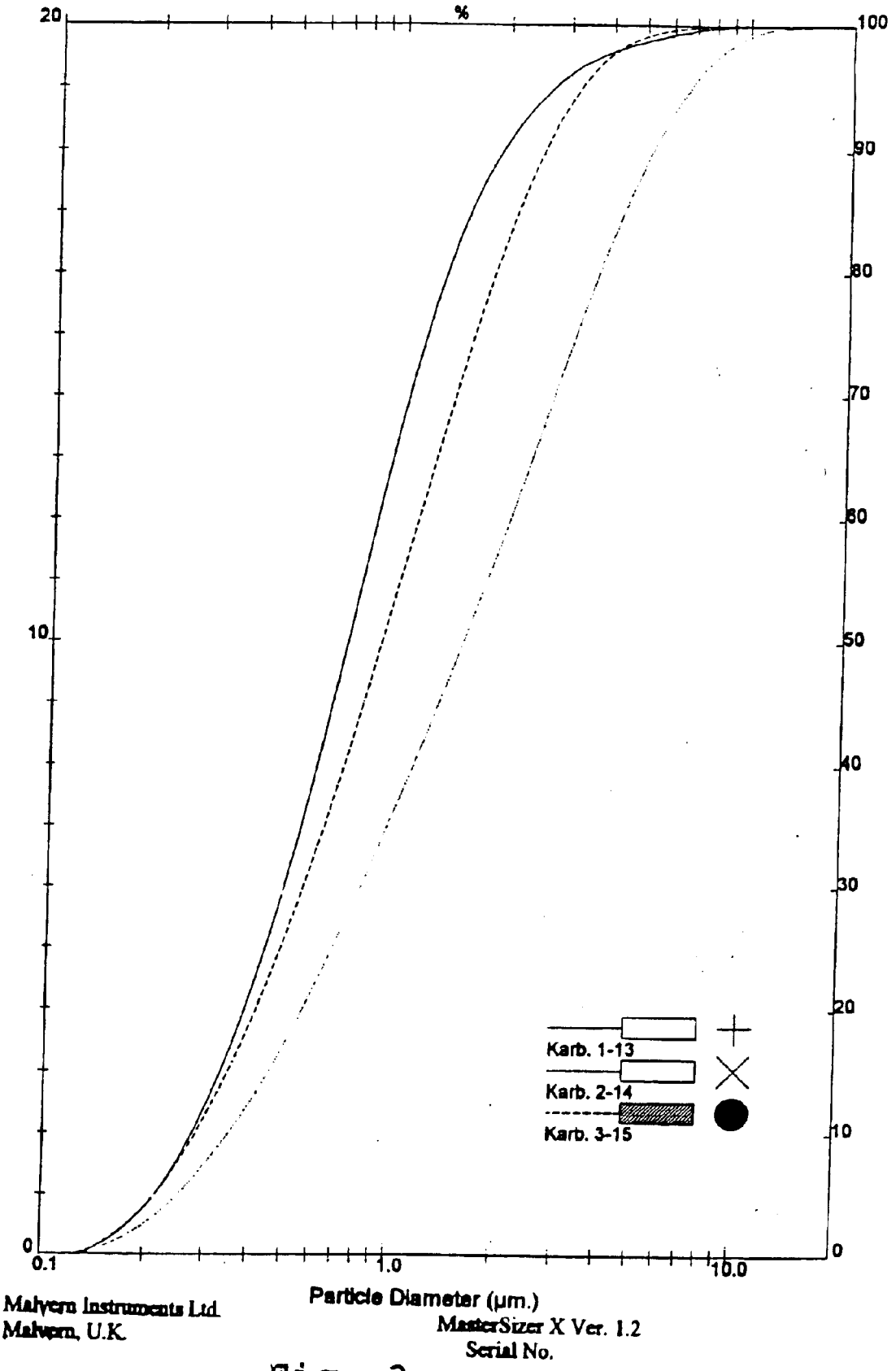
FIG. 3 shows the cumulative particle size distribution determined by laser diffraction for the carbonates 1 to 3 used in Example 3.

The immobilization points of pigments having a traditional and a steep distribution, respectively, were determined from carbonate/kaolin-based coating colours. FIG. 3 shows the cumulative particle size distribution for carbonates 4 to 6. The determination has been performed by a method based on laser diffraction. Table 5 indicates the compositions of the coating colours.

TABLE 5

The compositions of the coating colours

| | Precoating colours (parts by weight) | | Surface coating colours (parts by weight) | |
|---|---|---|---|---|
| | Conventional | According to the invention | Conventional | According to the invention |
| Carb. 4 | | 80 | | 70 |
| Carb. 5 | 80 | | | |
| Carb. 6 | | | 70 | |
| Kaol. 1 | 20 | 20 | | |
| Kaol. 2 | | | 30 | 30 |
| CMC | 0.7 | 0.7 | 0.7 | 0.7 |
| Latex | 10 | 10 | 10 | 10 |
| Additive 1 | 0.6 | 0.6 | | |
| Additive 2 | | | 6.6 | 6.6 |

Additive 1 is an optical brightner. Additives 2 include an optical brightner and other typical additives of coating colours. In both surface coating colours the same additives are incorporated in the same amounts The results will appear from Table 6:

TABLE 6

The immobilization poins of coating colours of Table 5

| Coating colour | Dry matter, % | Immobilization point, % |
|---|---|---|
| Pre-coat, conventional | 61.5 | 82.7 |
| Pre-coat, according to the invention | 61.8 | 78.1 |
| Surface coating colour, conv. | 60.5 | 80.0 |
| Surface coating colour, invention | 60.8 | 78.5 |

As the above results show, the immobilization point of precoating colours comprising carbonate pigments having a steep distribution (carb 1) appear at 4.6% units lower dry matter contents and even for surface coating colours at dry matters which are 1.9% units lower than for the reference. In both cases the reduction of the immobilization point is clear, for precoating colours it is significant.

EXAMPLE 4

Mist-Formation of Coating Colours

By using the receipt of Example 1 precoating colours were prepared and used for coating of a web by the film press method. A pilot coater was employed having an operating speed of 1500 m/s. The mist-formation was determined by placing a collecting vessel below the nip. The collecting vessel was attached to a scale which measured the mist in g/m$^2$. When the amount of coating applied on the paper was 10 g/m$^2$ and the dry matter of the conventional coating colour about 61% and that of the coating colour according to the invention was lower, i.e. about 60%, still the amount of collected mist was two times higher for the conventional coating colour than for that of the invention.

What is claimed is:

1. A method for coating a fibrous web comprising applying a coating color containing pigment particles to the surface of said web by film press coating with a coating speed of at least 1450 m/min; and drying said web to form a coated web;

wherein said coating color comprises pigment particles wherein a maximum of 35% of said particles are smaller than 0.5 $\mu$m, a maximum of 15% are smaller than 0.2 $\mu$m, a maximum of 10% are smaller than 0.1 $\mu$m and a maximum of 10% are larger than 2 $\mu$m.

2. The method according to claim 1, said paper web comprising mechanical aspen pulp and a chemical softwood pulp.

3. The method according to claim 1, wherein a maximum of 75% of said pigment particles of the coating color are smaller than 1 $\mu$m.

4. The method according to claim 1, wherein said coating color is applied with a coating speed of at least 1600 m/min.

5. The method according to claim 1, wherein said coating color contains a pigment selected from the group of calcium carbonate, calcium sulphate, aluminum silicate and aluminum hydroxide, magnesium silicate, titanium dioxide and/or barium sulphate and mixtures thereof.

6. The method according to claim 1, wherein said web is coated two times, wherein the first coating is applied by film press coating and the second coating is applied by blade coating.

7. The method according to claim 6, wherein 5 to 25 g coating color/m$^2$ is applied to said web by film press coating and 5 to 40 g coating color/m$^2$ is applied to said web by blade coating, said coating weights being calculated on basis of the dry matter of the coating colors.

8. The method according to claim 1, wherein said coating has a dry matter content of 50 to 65%.

* * * * *